US006746146B1

(12) United States Patent
Thomas

(10) Patent No.: US 6,746,146 B1
(45) Date of Patent: Jun. 8, 2004

(54) ASPHALT EMULSION SYSTEM PRODUCING AND SPRAYING PROCESS

(75) Inventor: Randy B. Thomas, Newport News, VA (US)

(73) Assignees: Kentucky Energy, L.L.C., Somerset, KY (US); Ikerd Coal Company, L.L.C., Somerset, KY (US)

( * ) Notice: Subject to any disclaimer, the term of this patent is extended or adjusted under 35 U.S.C. 154(b) by 0 days.

(21) Appl. No.: 10/243,225

(22) Filed: Sep. 13, 2002

Related U.S. Application Data

(62) Division of application No. 09/735,161, filed on Dec. 12, 2000.
(60) Provisional application No. 60/180,287, filed on Feb. 4, 2000.

(51) Int. Cl.[7] ..... B01F 15/02
(52) U.S. Cl. ..... 366/167.1; 386/174.1
(58) Field of Search ..... 366/167.1, 174.1, 366/175.2, 163.1, 163.2

(56) References Cited

U.S. PATENT DOCUMENTS

| | | | | | |
|---|---|---|---|---|---|
| 1,254,244 | A | * | 1/1918 | Leblanc | 406/153 |
| 2,361,150 | A | * | 10/1944 | Petroe | 366/175.2 |
| 2,543,517 | A | * | 2/1951 | Anderson | 239/602 |
| 3,819,157 | A | * | 6/1974 | Markfelt | 366/163.2 |
| 4,123,800 | A | * | 10/1978 | Mazzei | 366/163.2 |
| 4,390,281 | A | * | 6/1983 | Scriminger | 366/3 |
| 4,411,389 | A | * | 10/1983 | Harrison | 239/600 |
| 4,441,632 | A | | 4/1984 | Stoody | |
| 4,474,477 | A | * | 10/1984 | Smith et al. | 366/167.1 |
| 4,585,435 | A | * | 4/1986 | Vaillancourt | 604/518 |
| 4,993,884 | A | * | 2/1991 | Mueller et al. | 406/49 |
| 5,024,061 | A | | 6/1991 | Pfeil | |
| 5,171,090 | A | * | 12/1992 | Wiemers | 366/163.2 |
| 5,758,691 | A | * | 6/1998 | Nedderman, Jr. | 366/163.2 |
| 5,762,416 | A | * | 6/1998 | LeSire | 366/163.2 |
| 6,383,462 | B1 | | 5/2002 | Lang | |
| 6,427,543 | B1 | | 8/2002 | Torrison | |
| 6,427,724 | B2 | * | 8/2002 | Hua | 366/163.2 |
| 6,453,926 | B1 | * | 9/2002 | Baker | 366/167.1 |
| 2001/0003275 | A1 | * | 6/2001 | Hua | 122/31.1 |

FOREIGN PATENT DOCUMENTS

EP 1 106 838 * 6/2001

OTHER PUBLICATIONS

Asphalt Emulsions, Bematek Systems, Inc., Tek Talk, Oct. 1994, No. 200, 5 pages.
Colloid Mills, Bematek Systems, Inc., 3 pages.

* cited by examiner

*Primary Examiner*—Tony G. Soohoo
(74) *Attorney, Agent, or Firm*—Fulbright & Jaworski L.L.P.

(57) ABSTRACT

The present invention is directed to a process for creating an asphalt emulsion for use in manufacturing synthetic fuel and a novel process for introducing an asphalt emulsion into a synthetic fuel process.

25 Claims, 2 Drawing Sheets

ASPHALT EMULSION SYSTEM PRODUCING AND SPRAYING PROCESS

This application claims priority to U.S. Provisional Patent Application Serial No. 60/180,287, filed Feb. 4, 2000 and is also a divisional of U.S. patent application Ser. No. 09/735,161, filed Dec.12, 2000.

FIELD OF THE INVENTION

The field of the present invention is directed to a process for producing and applying an asphalt emulsion and, particularly, to a process for producing an oil-in-water asphalt emulsion, creating an aerosol from the asphalt emulsion using an atomizer and injecting the aerosol into an agitated coal stream.

BACKGROUND OF THE INVENTION

Developing efficient means for producing alternative fuel sources is important in societies dependent on fuel. The process for developing synthetic fuel ("synfuel") from coal is one such alternative. The synfuel process converts coal fines into a synthetic fuel through a chemical reaction with a petroleum-derived asphaltic binder. Asphaltic binders contain molecules with chemically reactive functional groups that can react with the feedstock coal fines to produce a synthetic fuel. As a result of these chemical reactions, such a synthetic fuel has a chemical composition that is significantly different from that of the feedstock.

According to one such synfuel process, the asphaltic binder is applied directly to the coal fines in a high-speed blender. This technology is effective in producing chemical change, but requires relatively high amounts ofbinder. Also, disadvantageously, the viscous melted asphalt is difficult to spread evenly onto coal fines and requires extensive mixing time.

According to another synfuel process, the asphaltic binder is applied in the form of an asphalt emulsion. The asphalt emulsion and the coal fines are mixed with to produce a rather gummy mixture. The asphalt emulsion generally comprises at least asphalt and water and may further include additives, such as various polymers to improve downstream processing. The resulting mixture of coal and asphalt emulsion is further processed. Pressure is applied to the mixture to expel the majority of the water, thus allowing the asphalt to more fully react with the carbon chain in the coal. Such asphalt emulsion processes involve the production of the asphalt emulsion at a central location and require that the resultant asphalt emulsion be shipped long distances. Accordingly, the asphalt emulsion must be relatively stable over a period of time. This often requires high levels of additives, such as soap or other stabilizers, to prevent premature breaking of the emulsion. An emulsion breaks when it spontaneously separates back into an oil phase and a water phase.

Hence, there exists a need for an improved asphalt emulsion-based synthetic fuel process, which overcomes the disadvantages of the existing processes.

SUMMARY OF THE INVENTION

An object of the present invention is to provide an improved process for introducing an asphalt into a synthetic fuel process.

A further object of the present invention is to provide an improved process for introducing an asphalt into a synthetic fuel process that allows for the debottlenecking of the synthetic fuel process.

A still further object of the present invention is to provide an improved process for introducing an asphalt into a synthetic fuel process that provides for higher throughput while still achieving the requisite chemical change necessary in a synthetic fuel process.

Another object of the present invention is to provide an improved process for producing an asphalt emulsion spray.

Yet another object of the present invention is to provide a more cost-effective way of producing an asphalt emulsion.

In order to achieve these and other objects, there is provided, in accordance with one aspect of the present invention, a process for introducing an asphalt into a synthetic fuel process, comprising the steps of introducing into the process an oil-in-water asphalt emulsion; passing the asphalt emulsion to an atomizer, adding to the atomizer a motivating gas to form an asphalt aerosol spray; agitating a coal fines feed stream; and injecting the aerosol spray into the agitated coal fines. The asphalt emulsion preferably comprises asphalt particles having an average diameter of about 5 microns or less. The asphalt emulsion can be anionic, cationic or non-ionic, more preferable anionic. The emulsion preferably has a pH of about 7.0 or greater. The asphalt preferably comprises no greater than about 50% by volume of the asphalt emulsion, more preferably about 30 to 50% by volume of the asphalt emulsion.

The introducing step preferably comprises manufacturing the asphalt emulsion upstream of the atomizer as part of a continuous, integral process for introducing an asphalt into a synthetic fuel process. The manufacturing step preferably comprises the further steps of introducing into the process an asphalt; creating a mixture of water and soap; mixing in a mixer the asphalt and the water and soap mixture to create an asphalt-soapy water mixture by passing the asphalt and the water and soap mixture along a common directional vector into a high turbulence mixing zone; and emulsifying the asphalt-soapy water mixture to create the asphalt emulsion. The asphalt preferably comprises no greater than about 50% by volume of the asphalt emulsion, more preferably about 30 to 50% by volume of the asphalt emulsion.

The aerosol of the spray preferably has a particle size of about 100 microns to about 500 microns. The atomizer preferably injects the aerosol spray as a flat spray. The gas is preferably selected from the group consisting of air, carbon dioxide, nitrogen and mixtures thereof. The agitated coal fines are preferably mechanically agitated. The mechanical agitating preferably involves continuously folding the coal fines. The aerosol spray preferably is generally evenly distributed over the coal fines.

In accordance with yet another aspect of the present invention, there is provided a process for spraying an asphalt emulsion onto coal in the manufacture of synthetic fuel, comprising the steps of introducing a motivating gas into an atomizer; introducing an oil-in-water asphalt emulsion into the atomizer; creating in the atomizer an atomized stream of emulsion and gas; and spraying the atomized stream onto an agitated coal fines stream. The asphalt emulsion preferably comprises asphalt particles having an average diameter of about 5 microns or less. The emulsion can be anionic, cationic or non-ionic, more preferably is anionic. The emulsion preferably has a pH of about 7.0 or greater. The asphalt preferably comprises no greater than about 50% by volume of the asphalt emulsion, more preferably about 30 to 50% by volume of the asphalt emulsion. The introducing step preferably comprises manufacturing the asphalt emulsion upstream of the atomizer as part of a continuous, integral process for introducing an asphalt into a synthetic fuel process. The manufacturing step preferably comprises the further steps of introducing into the process an asphalt; creating a mixture of water and soap; mixing in a mixer the asphalt and the water and soap mixture to create an asphalt-soapy water mixture by passing the asphalt and the water and soap mixture along a common directional vector into a high turbulence mixing zone; and emulsifying the asphalt-soapy water mixture to create the asphalt emulsion. The gas preferably is selected from the group consisting of air, carbon dioxide, nitrogen and mixtures thereof. The aerosol of the spray preferably has a particle size of about 100 microns to about 500 microns. The aerosol spray preferably is formed by mixing the asphalt emulsion and the motivating gas inside the atomizer. The atomizer preferably injects the aerosol spray as a flat spray. The agitating step preferably comprises mechanically agitating the coal fines. The mechanical agitating preferably involves continuously folding the coal fines.

In accordance with still another aspect of the present invention, there is provided a process for spraying an asphalt emulsion onto coal in the manufacture of synthetic fuel, comprising the steps of introducing into the process an asphalt binder; creating a mixture of water and soap; mixing the asphalt binder and the water and soap mixture to create an asphalt-soapy water mixture; passing the asphalt-soapy water mixture to an emulsifier; emulsifying the asphalt-soapy water mixture to create an oil-in-water asphalt emulsion; passing the asphalt emulsion to an atomizer; introducing a motivating gas stream into the atomizer; creating in the atomizer an atomized stream of emulsion and air, and spraying the atomized stream onto an agitated coal fines stream.

In accordance with still yet another aspect of the present invention, there is provided a mixer for mixing an asphalt emulsion and water, comprising a first flow chamber for receiving a first fluid at a first temperature; a second flow chamber joined to the first flow chamber, the second flow chamber including a third flow chamber housed within the second flow chamber, the third flow chamber for receiving a second fluid at a second temperature, wherein the flow chambers extend along a common directional vector; a fluid zone created by the area between the second and third flow chambers, wherein the first fluid is received within the fluid zone and the first fluid varies the temperature of the second fluid toward the temperature of the first fluid before mixing; a mixing zone for mixing the first and-second fluids to create a mixture; and an outlet for passing the mixture from the mixer. The second and third flow chambers are preferably in a pipe in a pipe relationship. The second flow chamber is preferably positioned at an angle of less than 90 degrees relative to the first flow chamber, as measured along their respective longitudinal axes. The first flow chamber and second flow chamber preferably form the arms of a Y and the outlet forms the base of the Y. The third flow chamber preferably terminates in the mixing zone. The end of the third flow chamber preferably forms a non-perpendicular angle relative to the longitudinal axis of the third flow chamber. The first flow chamber preferably includes a baffle. The baffle preferably extends into the first flow chamber a depth substantially equal to the end of the third flow chamber in the mixing zone.

In accordance with still yet another aspect of the present invention there is provided a mixer for an asphalt emulsion and a water-based mixture, comprising a first ingress having a baffle, wherein the ingress allows entry of a stream of soapy-water into the ingress; a second ingress comprising a first pipe and a second pipe positioned in the first pipe, the pipe in a pipe structure forming a concentric longitudinal area between the pipes, the inner pipe allowing for the flow of an asphalt binder and the concentric area allowing for the passage of soapy-water about the inner pipe, wherein the first and second ingress extend along a common directional vector; a junction area, wherein the first and second ingress meet to allow for the mixing of the asphalt binder and the soapy-water; and an egress which allows for flow of the mixture of soapy-water and asphalt mixture from the mixer. The second ingress preferably is positioned at an angle of less than 90 degrees relative to the first ingress, as measured along their respective longitudinal axes. The first ingress and second ingress preferably form the arms of a Y and the egress forms the base of the Y. The second pipe preferably terminates in the junction area. The end of the second pipe preferably forms a non-perpendicular angle relative to the longitudinal axis of the pipe. The baffle preferably extends into the first ingress a depth substantially equal to the end of the second pipe in the junction area.

In still yet another aspect of the present invention there is provided a process for spraying an asphalt emulsion onto coal in the manufacture of synthetic fuel, comprising the steps of introducing into the process an asphalt binder; creating a mixture of water and soap; mixing the asphalt binder and the water and soap mixture to create an asphalt-soapy water mixture, wherein the water and soap mixture and the asphalt binder are introduced into a mixer along a common directional vector and the asphalt binder is progressively cooled in the mixer, prior to mixing with the water and soap mixture; passing the asphalt-soapy water mixture to an emulsifier; emulsifying the asphalt-soapy water mixture to create an oil-in-water asphalt emulsion; continuously passing the asphalt emulsion to an atomizer; introducing an air stream into the atomizer; creating in the atomizer an atomized stream of emulsion and air; and spraying the atomized stream onto an agitated coal fines stream.

In accordance with a still further aspect of the present invention there is a process for producing an asphalt emulsion for use in manufacturing synthetic fuel, comprising the steps of introducing into the process an asphalt binder; creating a mixture of water and soap; mixing the asphalt binder and the water and soap mixture to create an asphalt-soapy-water mixture, wherein the water and soap mixture and the asphalt binder are introduced into a mixer along a common directional vector whereupon the asphalt binder is progressively and indirectly cooled by the water and soap mixture prior to mixing with the water and soap mixture; and emulsifying the asphalt-soapy water mixture to create an oil-in-water asphalt emulsion capable of being continuously applied. The progressive cooling preferably comprises introducing the water and soap mixture to the mixer through a first flow chamber; introducing the asphalt binder to the mixer through a second flow chamber; and passing at least a portion of the water and soap mixture into a third flow chamber, the second flow chamber being housed within the third flow chamber, wherein the water and soap mixture progressively cools the asphalt binder as the asphalt binder flows through the second flow chamber. The process preferably comprises the additional steps of passing the cooled asphalt binder and the water and soap mixture to a mixing zone and mixing the asphalt binder and the water and soap mixture.

In accordance with still yet another aspect of the present invention, there is an asphalt emulsion for use in manufacturing synthetic fuel, consisting essentially of an asphalt binder; water; and a soap at about 0.5 to 4% by total emulsion weight.

In accordance with still yet another aspect of the present invention there is a process for continuously applying an oil-in-water asphalt emulsion in a synthetic fuel process comprising the steps of creating an aerosol spray including a motivating gas and an asphalt emulsion; and continuously spraying the aerosol spray into a source of agitated coal fines.

The present invention provides multiple improvements including the ability to continually mix heated asphalt and a soapy water mixture to create an emulsion characterized by very small asphalt droplets and to apply same uniformly to coal fines in the production of synfuel. The invention provides for good contact between the coal fines and the asphalt and an efficient use of the asphalt as a result of its uniform application. Thus, the present process avoids processing disadvantages associated with batch processing. In addition, the present invention provides a more cost effective way of producing an asphalt emulsion and an atomized asphalt emulsion spray. Namely, the process requires reduced amounts of soap. An additional advantage to the process of the present invention is that it utilizes a continuous scheme of making emulsion, in contrast to a batch scheme wherein the emulsion remains unused for periods of time. Additionally, the emulsion form of asphalt divides the asphalt into extremely fine particles with very high surface area. This fine division, along with the relatively low viscosity of the emulsion facilitates spreading the binder much more uniformly across the surface of the coal fines, increasing interfacial contact between coal and binder. Increased interfacial contact between the binder and coal results in increased levels of chemical reaction and more efficient use of binder. Mixing time also is reduced. With increased efficiency, higher throughputs of synfuel can be realized using the same processing equipment. Furthermore, the emulsion of the present invention uses significantly less amounts of soap and requires no heavy oils or additives, such as synthetic polymers, because the continuous process of the invention allows utilization of an emulsion with a lower stability. The lower amount of soap utilized in the emulsion of the invention reduces the cost of the manufacturing of the emulsion. Finally, a method of applying the emulsion of the invention to the coal fines by aerosolization, or atomization, also results in a lower cost to produce synfuel. The asphalt emulsion producing process of the present invention allows a reduced amount of asphalt to be utilized, thus reducing significantly costs associated with the manufacturing of the synthetic fuel.

Other objects, features and advantages of the present invention will become apparent from a review of the detailed description of the preferred embodiments, including the illustrative drawings and the appended claims which follow.

DETAILED DESCRIPTION OF THE INVENTION

As previously noted, the present invention relates to a unique asphalt emulsion process utilized in the production of synthetic fuel and to a novel process for producing an asphalt emulsion spray. The emulsion process involves (1) the creation of an oil-in-water asphalt emulsion that converts sticky asphalt into a liquid that flows readily at room temperature, (2) the creation of an aerosol from the asphalt emulsion using an atomizer, (3) and the injection of the aerosol into a coal stream where the coal stream is subjected to agitation. The first step provides a much less viscous form of asphalt compared to sticky asphalt alone or a water-in-oil emulsion. The second step allows for a much finer dispersion of emulsion into coal than is achieved, for example, by simply spraying the emulsion into the coal fines. The third step allows for intense intermixing of coal and binder.

Asphalt emulsions used in the process are mixtures of asphaltic oil and water. Preferred emulsions are described as oil-in-water emulsions wherein oil droplets are dispersed in a continuous water phase. Such emulsions have much lower viscosity than the parent oil, since the water acts as a "lubricant layer" between the oil droplets. This facilitates the spreading of the asphaltic material on the surface of the coal in much the same way that a latex paint formulation facilitates the spreading of solid pigment on a wall.

Figure 1:
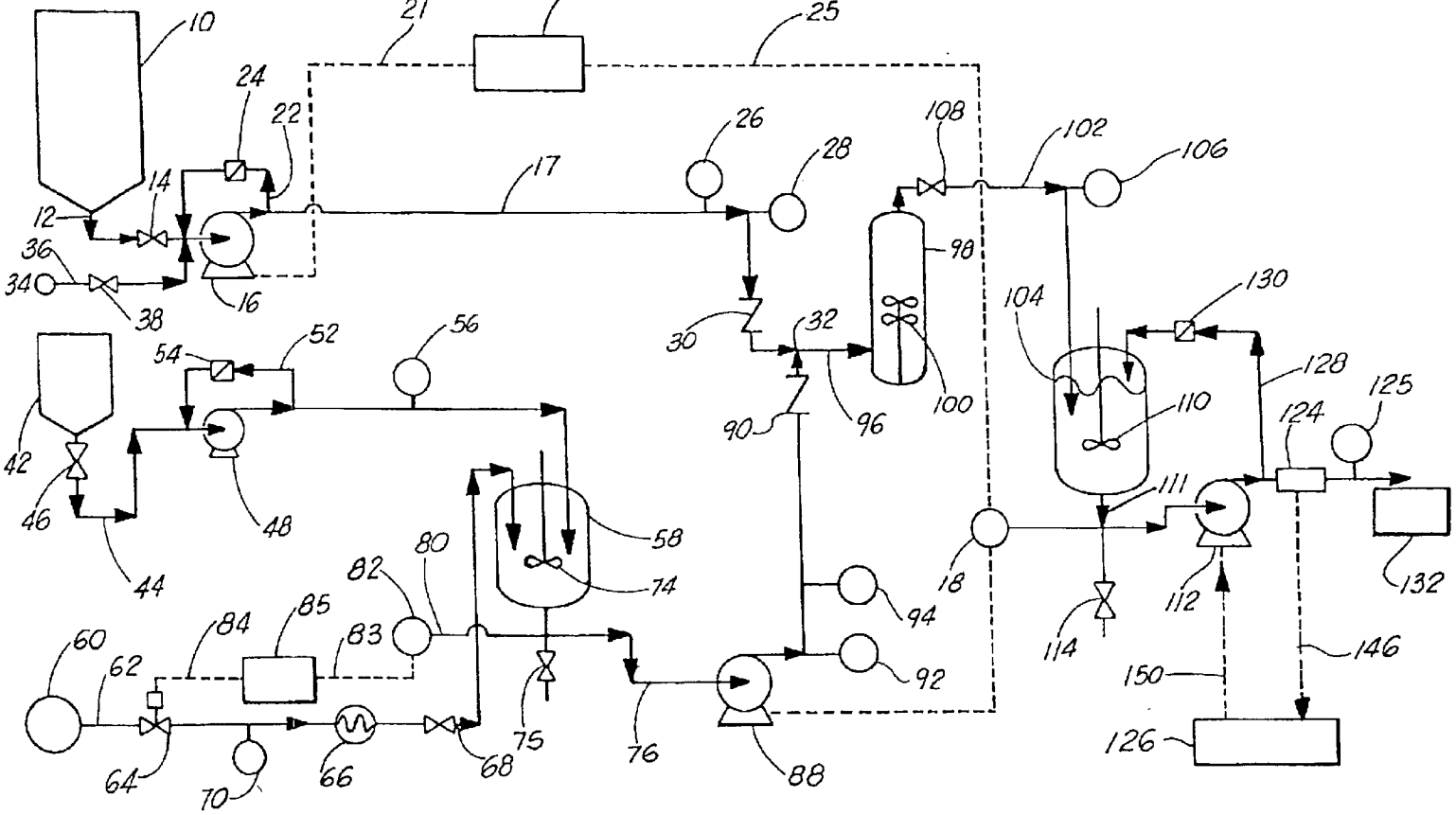
FIG. 1 is a process schematic or flowchart which illustrates the asphalt emulsion/synthetic fuel-producing system of the present invention.

According to FIG. 1, the current process includes asphalt storage tank (10) having flow line (12)attached thereto and exiting therefrom. Flow line (12) includes valve (14), and a pump (16) having a variable frequency drive (VFD). Flow line (17) exits the downstream side of pump (16) and includes a temperature gage (26) and a pressure gage (28) and further includes an anti-backwash valve (30). Valve (30), as the name implies, is a one-way valve that allows upstream to downstream asphalt flow along flow line (17), but prevents reverse or backwash flow. Flow line (17) culminates in a mixing device (32), which is discussed further below in much greater detail with respect to FIG. 2. Flow line (17) further includes an asphalt recirculation line (22), having a pressure release valve (24). The recirculation line (22) extends to flow line (12) downstream from the valve (14).

The process also includes a soap-containing vessel (42) having a flow line (44) attached thereto and exiting therefrom. Flow line (44) includes valve (46) and pump (48). Downstream of pump (48) flow line (44) includes a pressure indicator (56) and culminates in a water and soap mixing tank (58). Flow line (44) includes recirculation line (52) which allows for recirculation of soap to a point upstream of pump(48). Recirculation flow line (52) includes pressure release valve (54).

The process further includes water source (60) and flow line (62) extending therefrom. Flow line (62) includes a metering valve (64) for controlling water volume. Downstream of the metering valve (64) is an electric water heater (66) for heating the water and a valve (68) for controlling water flow. Water flow line (62) includes a pressure indicator (70) downstream of the metering valve (64). From the valve (68), water flow line (62) extends into the water and soap mixing tank (58). Mixing tank (58) includes an agitator (74) for mixing the soap and water introduced to the tank. Exiting from the bottom of the tank (58) is flow line (76), which carries the resultant soapy water mixture. Flow line (76) includes drain valve (75), which allows for draining the mixing tank (58) to comply to process considerations.

Connected to flow line (76) is a subsidiary fluid line (80) which is connected to a level indicating transducer (LIT) (82). The LIT (82) senses the static head pressure of the soapy water flow from the mixing tank (58), which in turn is a measure of the level in the tank and sends a signal, represented by line (83), to a meter (85) which then sends a signal to a metering valve (64) via signal line (84). The metering valve (64) then operates, depending on the signal delivered from the meter (85), to further open or close to adjust the volume of water flowing through line (62).

Returning to flow line (76), it continues to pump (88) and from there to the mixing device (32). Flow line (76) includes an anti-backwash valve (90) which operates in a fashion similar to anti-backwash valve (30). Flow line (76) also includes temperature measuring device (92) and pressure measuring device (94).

Extending from the mixing device (32) is flow line (96). Line (96) extends into an emulsifier (98) having a mixing means (100). The emulsifier produces an emulsion whereby the asphalt is broken into smaller, microscopic particles which are suspended in the soapy water. From the emulsifier (98), a flow line (102) extends to a surge tank (104). The surge tank includes an agitator (110) for maintaining the emulsion in its suspended condition. Flow line (102) includes a temperature indicator (106) and a valve (108).

A flow line (111) leaves the surge tank (104) and extends to a pump (112). Flow line (111) contains a drain valve (114). As with other drain lines, the valve allows the surge tank to be drained as required by operating conditions, such as shutdown. The fluid line (111) includes level indicator transmitter (LIT) (18) connected to a line (25) which sends an electric signal to a flow controller (23), which in turn sends a signal to pump (16) which allows for the adjustment of asphalt flow volume based upon the level in surge tank (104). In addition to controlling the pump (16), the LIT (18) sends a signal to pump (88) to simultaneously adjust the soapy water mixture flow rate.

Flow line (111) extends from pump (112) to a flow indicator transmitter (124). Signal line (146) extends from transmitter (124) to a flow indicator (126). Likewise, signal line (150) extends from flow indicator (126) to pump (112). The flow line (111) also includes a recirculation line (128) which recirculate the emulsion to the surge tank (104), if process conditions require, for example, if an obstruction is sensed downstream of a pump (112). The recirculation line (128) includes a generally-closed pressure release valve (130) which opens if recirculation is required. Emulsion flow line (111) contains a pressure gage (125) downstream of a FIT (124) which extends to an emulsion injection system (132) whereby the emulsion is injected into or onto the processed coal, for example, coal fines, as a further part of the synfuel process.

According to the operation of the present process, soap is pumped via pump (48) from tank (42) through valve (46) and into and through line (44) to mixing tank (58). A variety of soaps or surfactants may be used for purposes of the present invention. These materials generally have a hydrophilic, i.e., water-loving, end and an oleophilic, i.e., oil-loving, end. The surfactant forms a layer around the oil droplets of the resultant asphaltic emulsion oriented with the oleophilic ends in contact with the oil droplet and the hydrophilic ends pointed out into the aqueous phase. The surfactant prevents the re-agglomeration of the fine droplets formed by the emulsifier back into a bulk oil. A soap may be cationic, anionic or nonionic. Most preferably the surfactant is anionic. A preferred surfactant is an anionic emulsifier such as lignate-surfactant blend (Indulin SA-L, WESTVACO CHEMICAL DIVISION, Charleston Heights, S.C.). Another suitable surfactant includes the cationic coal soap #10 from AKJ Manufacturing, 14 North Washington St., Easton, Md. 21601, CM-550 and Stockhausen, Inc., P. O. Box 1949, Beckley, W.Va. 25802. An additional cationic soap is Vinsol AE from Hercules, Inc., Wilmington, Del.

Because the soap should be of a sufficiently low viscosity to be capable of pumping, the process should provide for sufficient heating and heat retention in the event that a soap is selected which requires the addition of heat for optimal pumping conditions. For example, the tank (42), flow line (44) or both can be heated and provided with sufficient insulation to assure proper soap viscosity. The pressure of the soap flowing through line (44) is read by transmitter (56) and the flow rate of the soap can be adjusted by the pump (48). In the event of an unacceptable increase in pressure in flow line (44), for example, as a result of down stream pluggage, pressure relief valve (54) opens to allow recirculation of the soap flow.

Water is introduced into the process from a source (60). A variety of sources may be utilized, for example, a municipal source can serve as a source of water. The water is pumped from source (60) through line (62) to the mixing tank (58). Valve (68), which is generally in the open position, can be utilized to control the water flow in flow line (62) to achieve desired emulsion characteristics as described in more detail below. The water pressure is sensed by pressure transmitter (70). The water may be, and generally is, heated by water heater (66). It is important according to the present invention to heat the water, and thus the soapy water mixture, to a temperature (1) sufficient to allow the soapy water mixture and the asphalt to be combined without losing asphalt fluidity, but (2) low enough to prevent vaporizing the water, thus producing a resultant emulsion in the emulsifier (98) that will remain in the emulsified state long enough to achieve the ends of the present invention. Though not limiting, emulsions having a viscosity of 100 cp or less are preferred for ease of pumping.

An important variable according to the present invention is the ratio of soapy water to asphalt. The present invention preferably utilizes an oil-in-water emulsion or dispersion, wherein small droplets of oil are dispersed in a continuous water phase. While a variety of ratios are useful, it is preferred that the asphalt comprises between about 30%–50% of the emulsion. The soapy water acts as an asphalt delivery system, which in combination with the novel process steps of the present invention, assures that the asphalt is delivered to the coal to be processed in a manner to achieve the greatest uniformity of asphalt application on the coal and intimacy between the coal and asphalt.

The heated water and the soap are mixed in mixing tank (58) by agitator (74). Generally, tank (58) will be heated or at least insulated to provide or prevent heat loss, as the case may be. Preferably, lines (44) and (62) extend below the liquid level of the tank to prevent the formation of excessive foaming of the mixture. The level of the tank is measured by level indicator transmitter (82). The resultant level indication signal (represented by line (83)) is sent from LIT (82) to meter (85), which in turn sends a signal (represented by line (84)) to metering valve (64). The signal adjusts the valve (64) to control water flow through line (62) and thus to the mixing tank (58). Preferably, the level of the soapy water mixture in the mixing tank (58) is maintained at generally a constant level. If drainage of the tank or line (76) is required, the valve (75) may be opened, though it is closed in normal operation.

Though not shown, LIT (82) also could send automatically a signal to valve (54) in soap recirculation line (52) to control the volume of soap flow through line (44). According to the embodiment of FIG. 1, however, the valve (54) is manually adjusted based upon readings from the mixing tank (58).

The resulting soapy water mixture exits the mixing tank (58) through line (76) and is pumped via pump (88) through the anti-backwash valve (90) to the mixing device (32). The pressure and temperature of the mixture are measured by pressure and temperature indicators (92) and (94), respectively.

The asphalt binder is introduced to the process from storage tank (10). The term "asphalt" or "asphalt binder" as used herein is defined generally as the substance obtained as a bottoms residue from a petroleum refining process; however, other asphalts may be used as binders. A skilled artisan is aware that any commercial grade of asphalt will work in the present invention, and a skilled artisan would be able to select an asphalt based on its specific properties and the resultant product which is desired. Such asphalts are identified according to a numbering system from AC1 to AC 60, which reflects the viscosity of the asphalt, with AC1 being the least viscous asphalt and AC60 being the most viscous. Non-limiting examples of asphalt binders that may be used in the present process include a "straight run asphalt"-type of asphalt binder, such as is produced by a refinery, such as Shell Oil Company, Inc. (St. Louis, Mo.) and cut-back asphalt, which is straight run asphalt that has been diluted, for example, by the addition of diesel fuel. Cut-back asphalt is available from a variety of manufacturers, such as Marathon, Shell and others.

A significant advantage of the present invention is that reduced amounts of asphalt are required in the synthetic fuels process. Specifically, beneficial results are achieved with asphalt binder amounts of from about 0.8%–7% by total weight of coal, preferably less than five percent (5%) and most preferably from about 1% to 2.5% by weight. Too little binder tends to result in an agglomeration that lacks sufficient strength for facile handling, while too much binder may result in a "sticky" agglomeration that clogs material handling equipment. The reduced binder results are due to the present process's ability to create an oil-in-water emulsion or dispersion in which the oil droplets are generally of a size of 5 microns or less and then to apply the emulsion or dispersion by a novel atomization spray process which intimately and uniformly coats the processed coal. This increase in surface interaction of the asphalt binder and coal requires less asphalt binder to achieve similar synfuel properties.

It is normally necessary to heat the asphalt to a sufficient temperature to achieve desirable viscosity properties so that the asphalt may be pumped from the tank (10). Accordingly, tank (10) is normally heated and lines (12) and (17) normally are heated and insulated. One skilled in the art is well aware of a variety of ways to heat and insulate such processing equipment. For example, the tank may be heated by use of a heat coil and lines (12) and (17) are heated by a heat tracing system. The asphalt binder, having a sufficiently low viscosity, is pumped via pump (16) into line (12) and through valve (14). The binder exits pump (16) via line (17), passes through anti-backwash valve (30) and into the mixing device (32). The temperature and pressure of the asphalt binder in line (17) are monitored by gages 26 and 28, respectively. If recirculation of the asphalt is required, for example, because of an obstruction in the line, the asphalt may be recirculated through line (22) ( the pressure release valve will open) to line (12) upstream of the pump.

The asphalt binder and soapy water mixture are mixed inside mixer (32). The mixer as used herein is a means by which the more viscous asphalt binder at an elevated temperature is cooled and mixed with a soapy water in such a manner as to avoid evaporation of the soapy water and to result in a highly mixed combination of the two immiscible liquids. This is achieved by a mixer with a cooling sleeve to progressively cool the inlet asphalt binder and, furthermore, with inlets for the two liquids that are aligned in such a way that they share a common velocity vector, which is preferably in the direction of the emulsifier, and which merge in a mixing zone of high turbulence.

Figure 2:
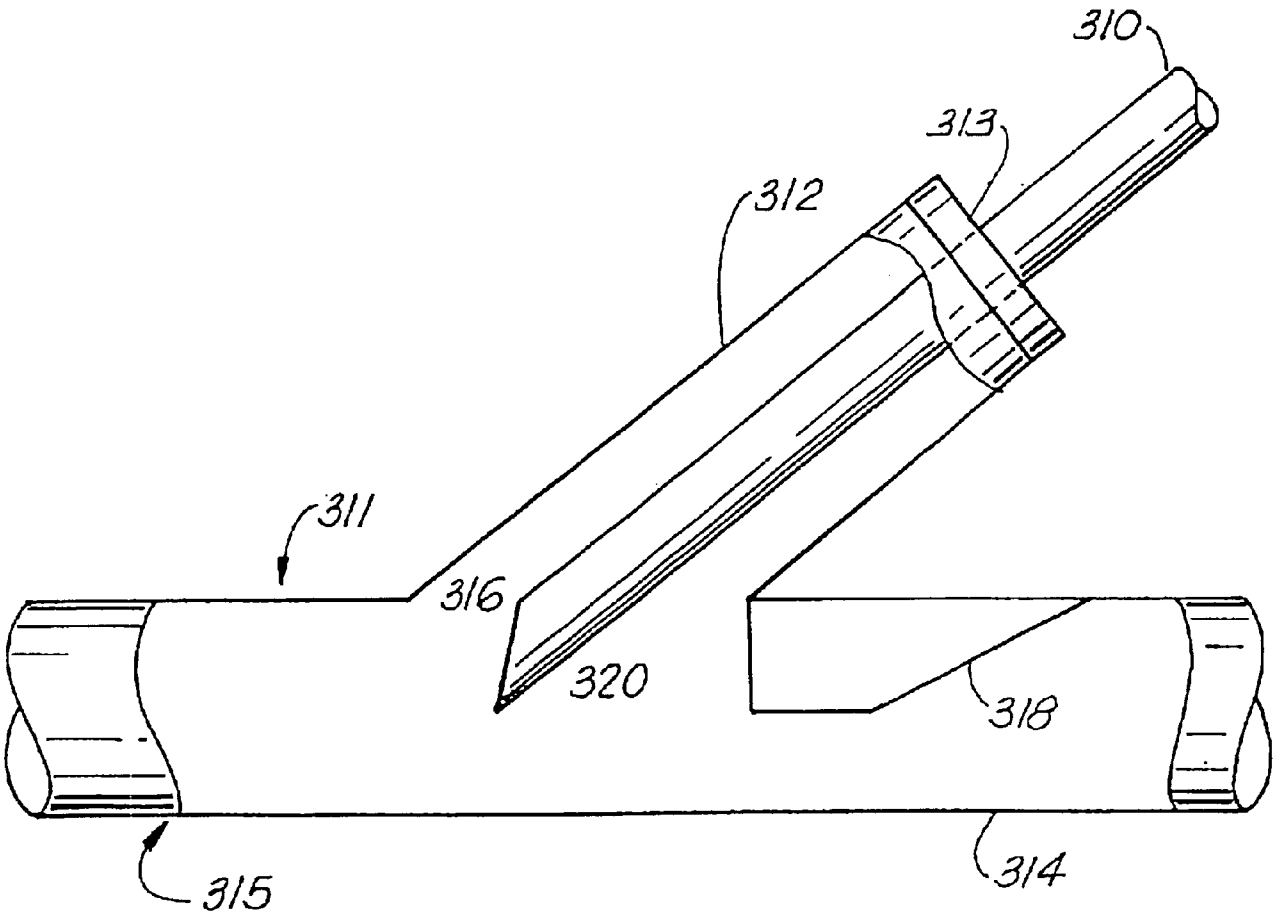
FIG. 2 is a schematic view illustrating the novel mixing tee utilized in the present inventive process.

The mixer of the present invention (32) is shown in FIG. 2. Referring to FIG. 2, the mixer is inside a pipe which, in a preferred embodiment, is the shape of a letter "Y". A Y-pipe (311) has two arms or inlets (312 and 314). Referring first to inlet (312), a pipe (310) is held by a securing means (313) inside an arm of pipe (312) and ends inside the joint or mixing zone (320) of the Y-pipe. Preferably, pipe (310) is centered within arm (312). The securing means (313) for the pipe (310) may comprise any means standard in the art, such as welding or use of a mechanical means. In one embodiment, the pipe (310) is threaded into means (313). The end of the pipe (310) ending inside the mixing zone (320) has a slanted face. Inlet (314) extends to the mixing zone (320) and includes baffle (318). The width of the baffle (318) extends to the same distance from the side wall of the pipe (314) as the bottom-most point of the end of the pipe (310) in zone (320).

The mixer (32) works as follows. Soapy water is introduced through tube (314) and passes under a baffle (318) which narrows the stream of water, creating a small eddy on its downstream side. Water fills the neck of the tube (312) around the entire surface of tube (310). The eddy keeps the water flowing around tube (310) and progressively and more evenly dissipates heat from the asphalt binder that flows through pipe (310), thus resulting in a gradual convergence of the asphalt binder and soapy water temperatures so as to avoid the evaporation of the water. Furthermore, the angle of the face of the end (316) of tube (310) and the relationship of inlet (310) and (314) results in the asphalt binder being injected into the water in a zone of high turbulence and a greater surface area for impact, thus allowing for a greater division of oil droplets in the soapy water and a better resultant mixture. In addition, the asphalt binder and soapy water preferably should have common velocity vectors and those vectors should preferably be directed towards the emulsifier, as described below.

The resultant asphalt binder/soapy-water mixture exits mixer (32) and passes through line (96) to emulsifier (98). The emulsifier forms the mixture of asphalt binder and soapy water into an intimate mixture of fine oil particles, in the neighborhood of 10 microns or less, preferably 5 microns or less,, which are suspended in the soapy water mixture. The emulsion preferably has a pH of 7.0 or greater. The present invention is not limited, however, to emulsions, but may include also dispersions. As is well-known in the art, an emulsion is a liquid in liquid mixture of two incompletely miscible liquids, and in the case of the current invention is a mixture of finely divided liquid oil droplets in soapy water. A dispersion is a solid in liquid mixture and, in the current invention, is a dispersion of solid oil particles in a soapy water mixture. The critical feature of the present invention is to provide micron sized oil particles or droplets dispersed in the soapy water mixture with the soapy water mixture acting as a delivery system for the suspended oil particles or droplets. A skilled artisan is aware that any implement to reduce particle size of the asphalt to the micron level, such as at least about 10 microns, could be used at this step. Furthermore, preferably, the emulsion of the present invention is anionic since anionic emulsions react better with the coal fines. However, a non-ionic or cationic emulsion may also be utilized.

The temperature of the emulsifier (98) is selected to assure optimal emulsion or dispersion properties which depends on the temperature of the asphalt binder. The temperature must be high enough to soften and melt the asphalt, allowing it to be dispersed into the aqueous phase. However, the temperature must also be low enough to prevent the aqueous phase from boiling, and to create sufficient interfacial tension between the oil and water phases to hinder re-agglomeration of the fine oil droplets. The temperature of the emulsion inside the emulsifier can be achieved in a preferred embodiment by control of the temperature of the asphalt and water coming in. In a specific embodiment this is achieved by control of water temperature from a water heater or in an alternative embodiment from volumetric control, such as with water. A thermocouple (not shown) at the exit of the emulsifier may be used as a signal to control the water heater outlet temperature.

The level in the product emulsion tank is controlled by product emulsion pump rate. The emulsion rate will vary with the concentration of asphalt in the emulsion and the coal rate.

The emulsion or dispersion exits the emulsifier (98) through valve (108) and through line (102) to surge tank (104). Preferably, the surge tank level is maintained at a level of at least 70% of its capacity. The temperature of the emulsion flow exiting the emulsifier and entering the surge tank is measured by temperature meter (106). The temperature of line (102) is selected to facilitate maintaining the emulsion in its emulsified or dispersed state to prevent agglomeration of the oil droplets within the aqueous dispersion. The appropriate temperature is directly related to the viscosity and temperature of the asphalt selected and the temperature of the soapy mixture.

In a preferred embodiment, tank (104) includes an agitator (110) which stirs the emulsion in order to maintain a homogeneous mixture and to liberate trapped air. This tank (104), in another preferred embodiment, serves as a surge tank to allow continuous operation of the synfuel production line even during short shutdowns of the emulsion system. The term "surge tank" as used herein is defined as a vessel which allows for continuous operation of a downstream step even during shutdown of an upstream step. An example of the downstream step is operation of a synfuel production line. An example of an upstream step is operation of an emulsification system.

As previously mentioned, indicator/transmitter (18) measures the emulsion level of surge tank (104) and sends an electric signal via line 25 to flow controller 23, which, in turn, sends a signal represented as line 21 to pump (16) to adjust the flow rate of the asphalt binder as necessary. The transmitter (18) likewise sends a signal represented by line 89 to pump (88) to control the flow rate of the soapy-water mixture as necessary.

The emulsion or dispersion in surge tank (104) is pumped via pump (112) through line (111). The flow transmitter (124) sends a signal designated as line (146) to flow controller (126), which, in turn, controls flow through line (111) by controlling the pump (112) via control signal (150). The emulsion or dispersion in flow line (111) flows into an emulsion injection system (132) for injecting the emulsion or dispersion onto the processed coal, for example, coal fines, as a further part of the synfuel process.

The injection system (132) provides for a unique process of applying an asphalt emulsion via an atomizer. Specifically, the emulsion or dispersion is introduced into injection system (132) along with a motivating gas. The motivating gas is introduced to the atomizer at high pressure. The motivating gas and the emulsion/dispersion are blended inside the atomizer to create very small emulsion particles suspended in the motivating gas. In preferred embodiments, the particle sizes range from about 100 to 500 microns. The motivating gas can be selected from a variety of gases, including air, carbon dioxide, nitrogen and mixtures thereof Preferably, the motivating gas is air. Also, in a preferred embodiment, the atomizer is heated.

The use of an aerosol atomizer of the invention is in contrast to pump atomizers utilized in the art, which force liquid through a small orifice. A variety of commercially available air atomizers are generally known but have not been used for the purpose of introducing an asphalt emulsion to coal fines for the manufacture of a synfuel. In a preferred embodiment the atomizer is inside a structure such as a screw, auger conveyer or blender which rotates at high speeds, such as approximately 360 revolutions per minute (rpm). As coal passes before the atomizer, the atomizer sprays the emulsion into the coal. In a preferred embodiment, the atomizer injects the aerosol spray as a flat spray.

The coal fines preferably are agitated during the atomized emulsion injection. This assures uniform dispersal of the emulsion onto and into the coal fines and continuously exposes fresh coal surface to the spray. The agitation preferably involves some type of mechanical agitation so that the coated particles are introduced back into the coal stream to maximize contact with other coal particles. Folding, most preferably, continuously folding, of the coal fines is a preferred means of such agitation. This mechanical agitation further minimizes the likelihood that the coal binder or synfuel will stick to the walls of the process chamber.

The resulting uniformly coated coal fines are further processed into synfuel. The standard synfuel process is well-known to those skilled in the art, and, therefore, will not be discussed in further detail here.

A variety of coals and a variety of forms of coal may be utilized in the present invention. Coal is a readily combustible rock containing more than fifty percent by weight of carbonaceous material, formed from compaction and induration of variously altered plant remains similar to those in peat. Most coal is fossil peat. Peat is an unconsolidated deposit of plant remains from a water-saturated environment such as a bog or a mire.

Any of the different types of coal can be used in the present invention. One factor that should be considered in selecting the coal to be used is the heating factor of the coal. Coal generally has a Btu (British thermal unit) of about 6,000–23,000, and in a more preferred embodiment, of about 11,000–13,000. Any source of the coal may be utilized, such as Appalachian coal, which can have about 10,000 to 14,000 Btu/lb, or coal from the Western United States, which can have as low as about 8,000 Btu/lb. A skilled artisan is aware that an average of Btu/lb from the coal and Btu/lb from the asphalt may achieve the desirable Btu level.

In a specific embodiment blends of different types of coal are created to reach the desired amounts of intrinsic properties such as sulfur content, ash content, energy content (Btu/lb) and moisture. An example of blending coal for desired purposes is described immediately below:

Desired Properties 12,100 Btu

10% Ash

10% Moisture 1.2% Sulfur

Blend the following (A, B and C):

| A. 12,000 Btu | B. 12,800 Btu | C. 11,500 Btu |
|---|---|---|
| 12% Ash | 6% Ash | 14% Ash |
| 12% Moisture | 4% Moisture | 14% Moisture |
| 1.5% Sulfur | 0.8% Sulfur | 1.0% Sulfur |

To achieve the desired result blend: 1 part A. 2 part B. 1 part C.

In a preferred embodiment of the present invention, the coal feedstock is in the form of "coal fines." Coal fines are fine coal screenings, which are crushed to a relatively uniform size, are utilized as feedstock material. Fine coal screenings can be processed by simple separation of the larger pieces of coal from the "run of mine" coal. A shaking table or screens are utilized to separate walnut size pieces, called Stoker coal, brick size pieces, called Block coal, and coal fines which are so small that they pass through the bottom of the final screen. Another type of coal fines is "Pond Fines," which originally retain an undesirable amount of liquid, such as water, and are subjected to processes to promote evaporation of the liquid. In a preferred embodiment the feedstock coal fines are uniform in appearance with no visible water.

While coal fines are the preferred coal form for use in the current invention, other forms of coal may be used, such as low grade raw coal and/or impoundment recovered waste coal, or combinations thereof. Another form of coal that may be used according to the present invention is "run of mine" which has been reduced to smaller, fine-sized fragments.

The present invention is further described below by reference to and discussion of specific embodiments based upon a coal fines flow rate of fifty tons per hour (50 tph). The present invention is equally useful and successful utilizing a variety of coal flow rates above and below the 50 tph rate.

A straight-run AC 20 asphalt is selected as the asphalt binder. The asphalt has an energy content of about 18,000 Btu/lb and is maintained at a temperature between about 190–360 F, preferably at about 270 F, to permit sufficient flow through the process. The asphalt tank is heated by means of a heating coil utilizing electrical resistive heating. The asphalt binder flow lines are also heated by a single line heat tracing and both the tank and asphalt binder flow lines are insulated. The asphalt flow rate depends on the coal flow rate and the percentage of asphalt binder to coal. As previously mentioned, a 50 tph coal fines flow rate has been selected. The percentage of asphalt binder, as previously noted, required by the present process is lower than the amounts required in conventional processes. Specifically, beneficial results are achieved with asphalt binders amounts of less than seven percent (7%), preferably less than about five percent (5%), and most preferably, from about 0.8 %–2.5% based upon total weight of the combined coal and asphalt. A binder amount of 1% by weight will be utilized for present purposes. For a 50 tph coal flow rate, the asphalt flow rate is about 1–10 gpm, more preferably at about 2 gpm.

Turning now to the soapy water mixture, which serves as a delivery system for the asphalt binder to the coal stream, the present process utilizes sufficient soapy water to assure that it comprises the majority component of the asphalt emulsion. Preferably, the amount of the soapy water is between about 50%–70% of the emulsion and according to the present discussion comprises about 60% by weight of the resultant of the asphalt emulsion (or a ratio of 1.5 parts soapy water to 1 part asphalt.)

The soap is an anionic lignate-surfactant blend referred to as Indulin SA-L from WESTVACO CHEMICAL DIVISION, Charleston Heights, S.C. The soap is heated to a temperature and viscosity to permit it to flow. The temperature utilized to achieve these properties is a matter of design choice. The soap flow rate, based upon a 50 tph, is thus preferably about 1–20 gph, more preferably is about 10 gph.

The water is supplied from a municipal source at ambient temperature and at a pressure determined by the water source, for example at about 160 psi. The water flow rate depends on the coal flow rate. For a coal flow rate of about 50 tph and an AC20 asphalt binder, water flows in line (62) at about 1–15 gpm in a preferred embodiment, at about 3–9 gpm in a more preferred embodiment, and at about 5 gpm in a most preferred embodiment. The water flows through line (62) to the metering valve (64) which controls the flow of same as a result of the metering signals received from the LIT (82). As previously discussed, the LIT (82) receives a signal representative of the level in tank (58), which in turn is reflective of the level in that tank, sends electric signal (83) representative of pressure signal to meter (85). Meter (85) converts that signal to signal (84) which controls the opening and closing of the metering valve (64) to allow increased or decreased water flow rates.

The metered water flow proceeds to the electric water heater (66). The water heater (66) may assume a variety of constructions and, in certain conditions, may not be necessary. For example, for those situations in which the asphalt binder is of a satisfactory temperature, the water may not be heated. A skilled artisan is aware that the water heater, if used, may be automatically controlled or manually controlled. Specifically, depending upon the temperature indicated by temperature indicator (106), the water heater (66) can be manually adjusted. Alternatively, an automatically controlled water heater may be used whereby the temperature measured at indicator (106) could be used to automatically adjust the temperature of the water heater. The electric water heater (66) is set at a temperature to give a desired emulsion temperature, which is a function of the asphalt temperature and the water temperature. The emulsion temperature is the weighted average temperature of the asphalt temperature and the water temperature. In the presently described embodiment, the water is at about 100 F. If an asphalt is at a hotter temperature than is desired, then the water temperature must be reduced accordingly. For instance, if the AC20 asphalt is at about 300 degrees F., the water should be at about 95 degrees F. If the AC20 asphalt is at about 320 degrees F., the water should be at about 75 degrees F.

The heated water then flows through valve (68) to the mixing tank (58) where it is mixed with the soap. The valve (68) is in a generally-open condition.

The resultant soapy water mixture is pumped at a temperature of about 100 F through line (76) by pump (88). In a preferred embodiment, the pump (88) is an Oberdorfer 994R gear pump from Oberdorfer Pumps, Inc., Syracuse, N.Y. 31221. The flow rate through flow line (76) is controlled by pump (88) which is monitored by LIT (18) to maintain a constant level in tank (104).

The flow line (76), which preferably is insulated, extends to the mixer (76). The soapy water enters through inlet (314) and flows past baffle (318). In a preferred embodiment, the pipe (310) has a diameter of about 0.45 inches. In another preferred embodiment the width of the baffle (318) extends 0.54 inches from the side wall of the pipe (314), which as stated above dictates that the lowest point of the end of tube (310) inside joint (320). The asphalt binder enters the mixer (32) through pipe (310) at a temperature of about 270 F and flows through pipe (310) to mixing zone (320). The pipe (310) is secured inside the tube (312) by threads. The angle of the face (316) of the end of tube (310), as measured relative to the longitudinal axis of pipe (310), is at least 141 degrees and in a preferred embodiment is 141 degrees. The diameter of pipe (310) is proportional to the diameter of the pipe (315) and preferably the diameter of pipe (310) is less than one-half the diameter of pipe (315). In a preferred embodiment, the diameters are about 0.45 inches and about 1.05 inches, respectively. The length of pipe (310) in a preferred embodiment is about 3.9 inches.

The baffle forms eddys in the incoming soapy water, which surround a pipe (310). The cooler soapy water around pipe (310) acts as a heat sink to progressively cool the asphalt toward the soapy water temperature to avoid evaporation of the soapy water when physically mixed with the asphalt. Furthermore, the mixer design results in a mixing zone (320) of high turbulence and thus substantial mixing of the two immiscible fluids. As an additional advantage of the current construction, the inlets share a common directional vector toward the emulsifier to assist further in transport of the mixture to the emulsifier.

The emulsifier is selected by a skilled artisan based on the properties of the asphalt binder which is utilized. In a preferred embodiment, the emulsifier is a colloid mill. In a specific embodiment wherein the asphalt is AC20, a KADY MILL is used (Kady International, Scarborough, Me.). The emulsifying element (100), in a specific embodiment, is driven by a 40 Horsepower (Hp) motor. The emulsion of the present invention preferably contains small droplets of asphalt in an aqueous soapy water mixture, in the case of the current example, in the form of an emulsion. The emulsion is maintained at a temperature to prevent agglomeration of the asphalt within the aqueous phase, and is directly related to the AC grade of the asphalt, which is associated with its viscosity, temperature of the asphalt and temperature of the soapy water. In a specific embodiment of a 50 tph coal flow rate and an AC20 asphalt, the emulsion is preferably between about 150 and 205 F, more preferably between about 180 F to 190 F, and most preferably about 180 F. If the emulsifier becomes too hot during operation, external exposure to liquid such as water may be utilized to cool it down and/or the water heater temperature may be reduced.

The emulsion of the present invention has greater adhesion and more uniform consistency than other emulsions in the art. That is, the emulsion has greater adhesion because it adheres to the surface of the coal more strongly than emulsions standard in the art due to both the method of making the emulsion and the method of applying the emulsion to the coal fines by aerosolization, or atomization. The emulsion of the invention has a more uniform consistency than other emulsions because there are more evenly dispersed particles of the asphalt suspended within the emulsion due to the method of making the emulsion as described herein.

A skilled artisan is aware that the ability to utilize the emulsion immediately following creation permits the emulsion to exclude polymers and/or increased levels of soap over commercially available emulsions. Commercially available emulsions exist, but they may have properties which are unnecessary in the present invention, in that they include heavy oil, which may contain undesirable products, and a great deal of soap, which is present to promote long-term stability. Furthermore, the commercially available emulsions may utilize synthetic polymers to enhance long-term stability. The advantageous process of the present invention allows a continuous, on-site produced alternative to making emulsions. This process does not require polymers and utilizes a reduced amount of surfactant in the emulsion because long-term stability is not necessary. In a preferred embodiment the emulsion of the present invention contains enough surfactant to stabilize it for a short period of time.

In another preferred embodiment the inclusion of heavier oils in the emulsion of the system produces a lower odor emulsion, in contrast to the foul-smelling commercially available emulsions, because the use of heavier oils reduces volatility.

Also, a lesser amount of soap or surfactant is required in the current process compared to commercially available emulsions, thus reducing the cost of the process. In a preferred embodiment the amount of soap or surfactant required does not exceed 2.5% of the emulsion, is more preferably from 0.1 to 1.9% of the emulsion, of the total volume of the emulsion and, in an even more preferred embodiment, is approximately about 1% of the emulsion. It should be noted, however, that a level of soap or surfactant that is too low should be avoided, otherwise the emulsifier may clog.

The flow rate of emulsion exiting the emulsifier through line (102), given the flow rates of the asphalt, water and soap, is about 4–20 gpm and, in a more preferred embodiment, is about 7 gpm. The temperature of line (102), as measured by indicator (106), is approximately 180–190 F and generally is between about 130 and 204 F. The pressure of line (102) is between about 6 and 20 psi. Line (102) terminates in surge tank (104), which has a capacity of about 100 gallons and is insulated.

The emulsion is pumped from surge tank (104) and controlled by flow controller (126). In one embodiment the flow is set to approximately 58 lbs/min. The emulsion next flows to the injection system (132), which injects the emulsion into and onto the coal fines. The injection system includes a heated air atomizer nozzle, which intakes about 100–200 cubic feet per minute of air at about 30–125 psi and also intakes emulsion at about 40–100 psi. The emulsion is blended inside the nozzle with the heated air. The emulsion of the present invention is applied at a pressure in the range of about 80 psi to 150 psi in the amount of about 2% on a total weight basis of the coal. Preferably, the aerosol of the spray has a particle size of about 100 microns to about 500 microns. In a preferred embodiment the coal is flowing at about 50 tph and the emulsion is flowing at about 1.25 tph, given a 1.5 water to oil ratio of an emulsion. The resulting coated coal fines are further processed utilizing known synfuel processes to produce a resultant synfuel product.

In a specific example of the synfuel process, synfuel coal agglomerates are produced by the present processing having heating values, ash content, sulfur content, and grindability generally of the quality of the coal, changed somewhat by the asphalt.

While the preceding discussion is based upon a coal flow rate of 50 tph, a skilled artisan is aware that in the event that a different volume of coal fines is utilized, the volumes of binder, water and soap may be scaled in a linear fashion. For example, to maintain a 1% asphalt content of the resultant synfuel product upon doubling of the coal rate, the amounts of asphalt, water and soap are therein also doubled. Also, a skilled artisan will recognize that different grades of asphalt may be used in the current invention. Additionally, it is understood that a skilled artisan may vary coal flow rates, asphalts, asphalt flow rates, soaps, soap flow rates, water qualities, water flow rates, asphalt to coal ratios, emulsions, emulsion flow rates, temperatures, pressures and quantities of compositions according to design conditions, and, furthermore, would know how to adjust specific parameters to achieve a desirable emulsion or synthetic fuel product. In addition, a skilled artisan is aware that large step changes to any step of the process of the present invention should be avoided and that ramping of parameters should proceed slowly.

One skilled in the art also will understand that a variety of industry available products may be substituted for various of the components discussed above, such as valves, transmitters, and pressure, flow and temperature indicators. A representative example of meter (85) is Model No. 907.50.970 sold by WIKA Instrument Corp., 1000 Wiegand Blvd., Lawrenceville, Ga. 30243, and is referred to in the industry as a WIKA pressure transmitter. A representative example of LIT (82) is Model No. 891.13.520 also sold by WIKA Instrument Corp. Another example of a transmitter (82) is Model No.15H made by Baldor Electric Co., P. O. Box 2400, Fort Smith, Ak. 72902. Similarly, a variety of pumps may be used. For example, pumps from Hitachi, Osaka, Japan and Gorman-Rupp Pumps, Milwaukee, Wis. In a preferred embodiment the flow controllers (23 and 126) of the invention are Model No. UDC 3300 Controllers from Honeywell, Inc., 1100 Virginia Dr., Fort Washington, Pa. 19034.

One skilled in the art readily appreciates that the present invention is well adapted to carry out the objectives and obtain the ends and advantages mentioned as well as those inherent therein. Processes, methods, equipment and means described herein are presently representative of the preferred embodiments and are intended to be exemplary and are not intended as limitations of the scope. Changes therein and other uses will occur to those skilled in the art which are encompassed within the spirit of the invention.

What is claimed is:

1. A mixer for mixing an asphalt emulsion and water, comprising:

a first flow chamber for receiving a first fluid at a first temperature and including a baffle;

a second flow chamber joined to said first flow chamber, said second flow chamber including a third flow chamber housed within said second flow chamber, said third flow chamber for receiving a second fluid at a second temperature, wherein said flow chambers extend along a common directional vector;

a fluid zone created by the area between said second and third flow chambers, wherein said first fluid is received within said fluid zone and said first fluid varies the temperature of said second fluid toward the temperature of said first fluid before mixing;

a mixing zone for mixing said first and second fluids to create a mixture; and an outlet for passing said mixture from the mixer.

2. A mixer as claimed in claim 1, wherein said second and third flow chambers are in a pipe in a pipe relationship.

3. The mixer as claimed in claim 1, wherein said second flow chamber is positioned at an angle of less than 90 degrees relative to said first flow chamber, as measured along their respective longitudinal axes.

4. The mixer as claimed in claim 1, wherein said first flow chamber and second flow chamber form the arms of a Y and said outlet forms the base of said Y.

5. The mixer as claimed in claim 1, wherein said third flow chamber terminates in said mixing zone.

6. The mixer as claimed in claim 1, wherein the end of said third flow chamber forms a non-perpendicular angle relative to the longitudinal axis of said third flow chamber.

7. The mixer as claimed in claim 1, wherein said baffle extends into said first flow chamber a depth substantially equal to the end of said third flow chamber in said mixing zone.

8. A mixer for an asphalt emulsion and a water-based mixture, comprising:

a first ingress having a baffle, wherein said ingress allows entry of a stream of soapy-water into said ingress;

a second ingress comprising a first pipe and a second pipe positioned in said first pipe, said pipe in a pipe structure forming a concentric longitudinal area between said pipes, said inner pipe allowing for the flow of an asphalt binder and said concentric area allowing for the passage of soapy-water about said inner pipe, wherein said first and second ingress extend along a common directional vector;

a junction area, wherein said first and second ingress meet to allow for the mixing of said asphalt binder and said soapy-water, and an egress which allows for flow of said mixture of soapy-water and asphalt mixture from said mixer.

9. The mixer as claimed in claim 8, wherein said second ingress is positioned at an angle of less than 90 degrees relative to said first ingress, as measured along their respective longitudinal axes.

10. The mixer as claimed in claim 8, wherein said first ingress and second ingress form the arms of a Y and said egress forms the base of said Y.

11. The mixer as claimed in claim 8, wherein said second pipe terminates in said junction area.

12. The mixer as claimed in claim 8, wherein the end of said second pipe forms a non-perpendicular angle relative to the longitudinal axis of said pipe.

13. The mixer as claimed in claim 8, wherein said baffle extends into said first ingress a depth substantially equal to the end of said second pipe in said junction area.

14. A mixer for an asphalt emulsion and a water-based mixture, comprising:

a first ingress having a baffle, wherein said ingress allows entry of a stream of a first fluid into said ingress;

a second ingress comprising a first pipe and a second pipe positioned in said first pipe, said pipe in a pipe structure forming a concentric longitudinal area between said pipes, said inner pipe allowing for the flow of a second fluid and said concentric area allowing for the passage of said first fluid about said inner pipe, wherein said first and second ingress extend along a common directional vector;

a junction area, wherein said first and second ingress meet to allow for the mixing of said first fluid and said second fluid; and an egress which allows for flow of said mixture of said first fluid and said second fluid from said mixer.

15. The mixer as claimed in claim 14, wherein said second ingress is positioned at an angle of less than 90 degrees relative to said first ingress, as measured along their respective longitudinal axes.

16. The mixer as claimed in claim 14, wherein said first ingress and second ingress form the arms of a Y and said egress forms the base of said Y.

17. The mixer as claimed in claim 14, wherein said second pipe terminates in said junction area.

18. The mixer as claimed in claim 14, wherein the end of said second pipe forms a non-perpendicular angle relative to the longitudinal axis of said pipe.

19. The mixer as claimed in claim 14, wherein said baffle extends into said first ingress a depth substantially equal to the end of said second pipe in said junction area.

20. A mixer for mixing an asphalt emulsion and water, comprising:

a first flow chamber for receiving a first fluid and including a baffle;

a second flow chamber joined to said first flow chamber, said second flow chamber including a third flow chamber housed within said second flow chamber, said third flow chamber for receiving a second fluid, wherein said second and third flow chambers extend along a common directional vector;

a fluid zone created by the area between said second and third flow chambers, wherein said first fluid is received within said fluid zone;

a mixing zone for mixing said first and second fluids to create a mixture; and an outlet for passing said mixture from the mixer.

21. A mixer as claimed in claim 20, wherein said second and third flow chambers are in a pipe in a pipe relationship.

22. The mixer as claimed in claim 20, wherein said second flow chamber is positioned at an angle of less than 90 degrees relative to said first flow chamber, as measured along their respective longitudinal axes.

23. The mixer as claimed in claim 20, wherein said first flow chamber and second flow chamber form the arms of a Y and said outlet forms the base of said Y.

24. The mixer as claimed in claim 20, wherein said third flow chamber terminates in said mixing zone.

25. The mixer as claimed in claim 20, wherein the end of said third flow chamber forms a non-perpendicular angle relative to the longitudinal axis of said third flow chamber.

* * * * *